US007830237B1

(12) United States Patent
Chen

(10) Patent No.: US 7,830,237 B1
(45) Date of Patent: Nov. 9, 2010

(54) TRANSFORMER

(75) Inventor: Hsien-Chih Chen, Taipei (TW)

(73) Assignee: Intelextron Inc., Tortola (VG)

( * ) Notice: Subject to any disclaimer, the term of this patent is extended or adjusted under 35 U.S.C. 154(b) by 0 days.

(21) Appl. No.: 12/544,004

(22) Filed: Aug. 19, 2009

(51) Int. Cl.
*H01F 27/02* (2006.01)
*H01F 27/28* (2006.01)
*H01F 17/04* (2006.01)

(52) U.S. Cl. ..... 336/220; 336/83; 336/221; 336/222

(58) Field of Classification Search ..... 336/83, 336/220–222
See application file for complete search history.

(56) References Cited

U.S. PATENT DOCUMENTS 6,859,130 B2 * 2/2005 Nakashima et al. ..... 336/200
7,714,687 B2 * 5/2010 Marui et al. ..... 336/198
2008/0211613 A1 * 9/2008 Lin et al. ..... 336/83
2009/0289751 A1 * 11/2009 Nagano et al. ..... 336/221

* cited by examiner

*Primary Examiner*—Anh T Mai
*Assistant Examiner*—Ronald W Hinson
(74) *Attorney, Agent, or Firm*—Banger Shia

(57) ABSTRACT

A transformer includes an iron core having a shaft around which a plurality of coil modules is mounted. Each coil module includes spiral, upper and lower coil sections each having an outer loop and a plurality of inner loops received in and coplanar with the outer loop. The inner loops of the spiral upper coil section and the inner loops of the spiral lower coil section include a common innermost loop through which the shaft extends. Upper and lower ends of each coil module are respectively interconnected to the outer loops of the upper and lower coil sections. The spiral upper section is superimposed on the spiral lower section to form a two-layer structure. The lower end of an upper one of two adjacent coil modules interconnected to the upper end of a lower one of the two adjacent coil modules.

10 Claims, 11 Drawing Sheets

TRANSFORMER

BACKGROUND OF THE INVENTION

1. Field of the Invention

The present invention relates to a transformer and, more particularly, to a low-profile transformer without a bobbin to reduced the volume.

2. Description of the Related Art

FIG. 9 shows a conventional transformer including a bobbin 1', an iron core 2', and primary and secondary windings 3' and 4'. The bobbin 1' includes a sleeve 11' having a central through-hole 13' through which the iron core 2' extends. A groove 12' surrounds the sleeve 11' and receives the primary and secondary windings 3' and 4' spaced from each other by an insulating layer 14'. The primary and secondary windings 3' and 4' are enamel-covered wires. The iron core 2' and the primary and secondary windings 3' and 4' create electromagnetic induction for voltage-changing purposes with the ratio of turns of the primary and secondary windings 3' and 4' being one of the factors. The bobbin 1' and the primary and secondary windings 3' and 4' wound along an axis of the bobbin 1' cause limitation to the reduction of the volume and height of the transformer, failing to provide a compact device. Furthermore, the sizes of the primary and secondary windings 3' and 4' are decided by the size of the bobbin 1' around which they are mounted. Namely, it is difficult to create specifications for the primary and secondary windings 3' and 4' due to the winding shapes.

Taiwan Patent Publication No. 422-400 discloses a spiral coil 5' for transformers. As illustrated in FIGS. 10 and 11, the coil 5' includes an outer end 51' extending from an outermost loop of the coil 5'. The other end 52' of the coil 5' extends from an innermost loop and across the loop portion of the coil 5'. Thus, more turns can be provided within a lower height A substantially equal to two times of the diameters of the wire. However, there is still a waste of space (see the section indicated by B).

Thus, a need exists for a low-profile transformer with a reduced volume without using a bobbin.

BRIEF SUMMARY OF THE INVENTION

The present invention solves this need and other problems in the field of low-profile transformers by providing, in a preferred form, a transformer including an iron core having a shaft. A plurality of coil modules is mounted around the shaft. Each coil module is electrically conductive and has an insulating surface. Each coil module includes spiral, upper and lower coil sections and upper and lower ends electrically connected to each other via the spiral, upper and lower coil sections. The spiral upper coil section includes an upper, outer loop and a plurality of upper, inner loops received in and coplanar with the upper, outer loop and having diameters smaller than the upper, outer loop. The spiral lower coil section includes a lower, outer loop and a plurality of lower, inner loops received in and coplanar with the lower, outer loop and having diameters smaller than the lower, outer loop. The plurality of upper, inner loops and the plurality of lower, inner loops include a common innermost loop through which the shaft of the iron core extends. The upper end is interconnected to the upper, outer loop, and the lower end is interconnected to the lower, outer loop. The spiral upper section is superimposed on the spiral lower section to form a two-layer structure. The lower end of an upper one of two adjacent coil modules interconnected to the upper end of a lower one of the two adjacent coil modules.

In a second aspect, a transformer includes an iron core having a shaft. A primary winding is mounted around the shaft and includes a plurality of first coil modules. Each first coil module is electrically conductive and has a first insulating surface. Each first coil module includes a spiral, first, upper coil section, a spiral, first, lower coil section, and upper and lower ends electrically connected to each other via the spiral, first, upper and lower coil sections. The spiral, first upper coil section includes a first upper, outer loop and a plurality of first, upper, inner loops received in and coplanar with the first, upper, outer loop and having diameters smaller than the first, upper, outer loop. The spiral, first, lower coil section includes a first, lower, outer loop and a plurality of first, lower, inner loops received in and coplanar with the first, lower, outer loop and having diameters smaller than the first, lower, outer loop. The plurality of first, upper, inner loops and the plurality of first, lower, inner loops include a first common innermost loop through which the shaft of the iron core extends. The upper end of each first coil module is interconnected to the first, upper, outer loop of the first coil module. The lower end of each first coil module is interconnected to the first, lower, outer loop of the first coil module. The spiral, first, upper section is superimposed on the spiral, first, lower section to form a first two-layer structure. The lower end of an upper one of two adjacent first coil modules is interconnected to the upper end of a lower one of the two adjacent first coil modules. A secondary winding is mounted around the shaft and includes a plurality of second coil modules. Each second coil module is electrically conductive and has a second insulating surface. Each second coil module includes a spiral, second, upper coil section, a spiral, second, lower coil section, and upper and lower ends electrically connected to each other via the spiral, second, upper and lower coil sections. The spiral, second, upper coil section includes a second upper, outer loop and a plurality of second, upper, inner loops received in and coplanar with the second, upper, outer loop and having diameters smaller than the second, upper, outer loop. The spiral, second, lower coil section includes a second, lower, outer loop and a plurality of second, lower, inner loops received in and coplanar with the second, lower, outer loop and having diameters smaller than the second, lower, outer loop. The plurality of second, upper, inner loops and the plurality of second, lower, inner loops include a second common innermost loop through which the shaft of the iron core extends. The upper end of each second coil module is interconnected to the second, upper, outer loop of the second coil module. The lower end of each second coil module is interconnected to the second, lower, outer loop of the second coil module. The spiral, second, upper section is superimposed on the spiral, second, lower section to form a second two-layer structure. The lower end of an upper one of two adjacent second coil modules is interconnected to the upper end of a lower one of the two adjacent second coil modules.

In a third aspect, a transformer includes an iron core having a shaft with an axis. Upper and lower coil modules are mounted around the shaft. Each of the upper and lower coil modules is electrically conductive and has an insulating surface. Each of the first and second coil modules includes spiral, upper and lower coil sections and upper and lower ends electrically connected to each other via the spiral, upper and lower coil sections. The spiral upper coil section includes an upper, outer loop and a plurality of upper, inner loops received in and coplanar with the upper, outer loop and having diameters smaller than the upper, outer loop. The spiral lower coil section includes a lower, outer loop and a plurality of lower, inner loops received in and coplanar with the lower, outer loop and having diameters smaller that the lower, outer loop.

The plurality of upper, inner loops and the plurality of lower, inner loops include a common innermost loop through which the shaft of the iron core extends. The upper end is interconnected to the upper, outer loop. The lower end is interconnected to the lower, outer loop. The spiral upper section is superimposed on the spiral lower section to form a two-layer structure. The lower end of the upper coil module is interconnected to the upper end of the lower coil module. The upper and lower coil modules are spaced by a spacing along the axis. A conductive plate includes an arcuate section defining a coupling hole through which the shaft extends. The conductive plate is received in the spacing. The arcuate section includes two spaced ends. First and second legs respectively extend from the two spaced ends of the arcuate section and spaced from each other. The conductive plate is covered by an insulating layer.

The transformers have low profiles and reduced heights along the axis.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 1:
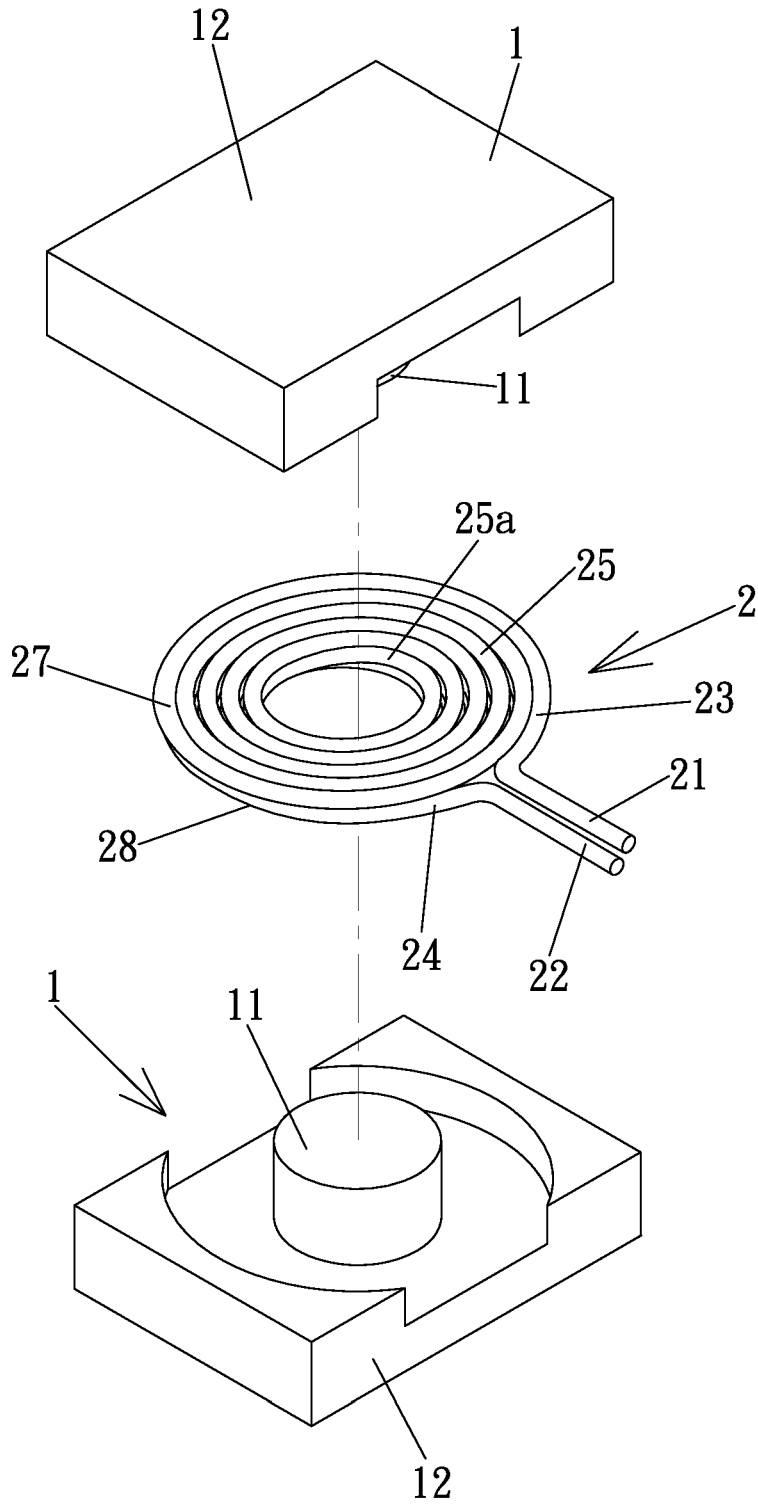
FIG. 1 shows an exploded, perspective view of a coil module and an iron core according to the preferred teachings of the present invention.
Figure 2:
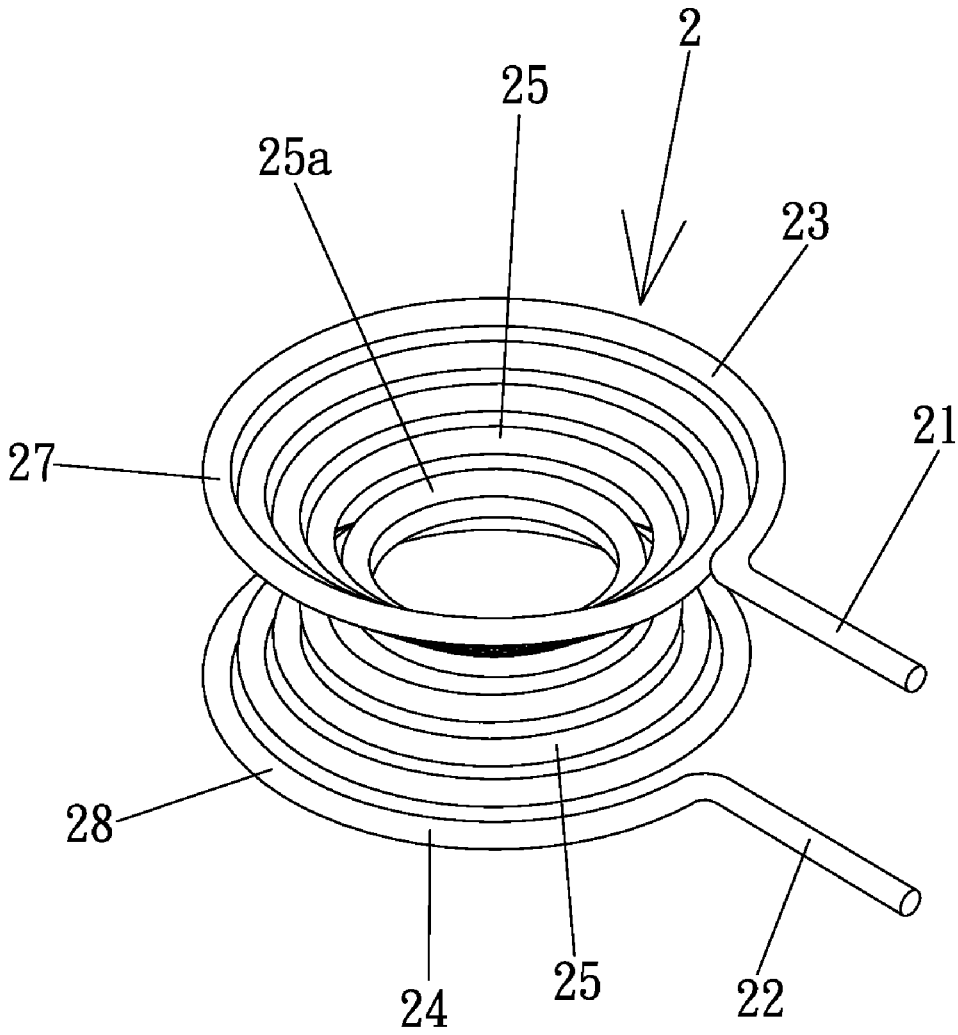
FIG. 2 shows a perspective view of the coil module of FIG. 1.

FIG. 1 shows a coil module 2 and an iron core 1 according to the preferred teachings of the present invention. FIG. 2 shows the coil module 2 stretched along an axis to show the winding pattern of the coil module 2. It can be appreciated that a transformer according to the preferred teachings of the present invention can include more than one coil module 2. The iron core 1 is of EE type, EI type or any other type. The iron core 1 includes a shaft 11 in the form shown having two shaft sections each extending from a base 12. The coil module 2 is electrically conductive and formed by a wire covered by electrically insulating enamel that provides an insulating surface for the wire. Namely, the coil module 2 is formed by bending an enamel-covered wire. Specifically, the coil module 2 includes spiral, upper and lower coil sections 27 and 28 and upper and lower ends 21 and 22 electrically connected to each other via the spiral, upper and lower coil sections 27 and 28. The spiral upper coil section 27 includes an upper, outer loop 23 and a plurality of upper, inner loops 25 received in and coplanar with the upper, outer loop 23 and having diameters smaller than the upper, outer loop 23. The spiral lower coil section 28 includes a lower, outer loop 24 and a plurality of lower, inner loops 25 received in and coplanar with the lower, outer loop 24 and having diameters smaller than the lower, outer loop 24. The number of turns of each of the upper and lower inner loops 25 can be four, five, six, eight, ten, etc., depending on the design needs. The upper, inner loops 25 and the lower, inner loops 25 are interconnected to each other by a common innermost loop 25*a* having the smallest diameter. The shaft 11 of the iron core 1 extends through the common innermost loop 25*a*. The upper end 21 is interconnected to the upper, outer loop 23. The lower end 22 is interconnected to the lower, outer loop 24. The spiral upper section 27 is superimposed on the spiral lower section 28, forming a two-layer structure. The coil module 2 can be formed by a winding machine and of a standard specification. The coil module 2 can include more turns by the two-layer structure to reduce the height of the transformer. The upper, outer loop 23 is aligned with the lower, outer loop 24, and the upper, inner loops 25 are aligned with the lower, inner loops 25. The coil module 2 is enhanced in the structural strength and, thus, less likely to deform while allowing mass production of certain specifications. The primary and secondary windings 3 and 4 are intermediate the bases 12 of the iron core 1 along the axis.

Figure 3:
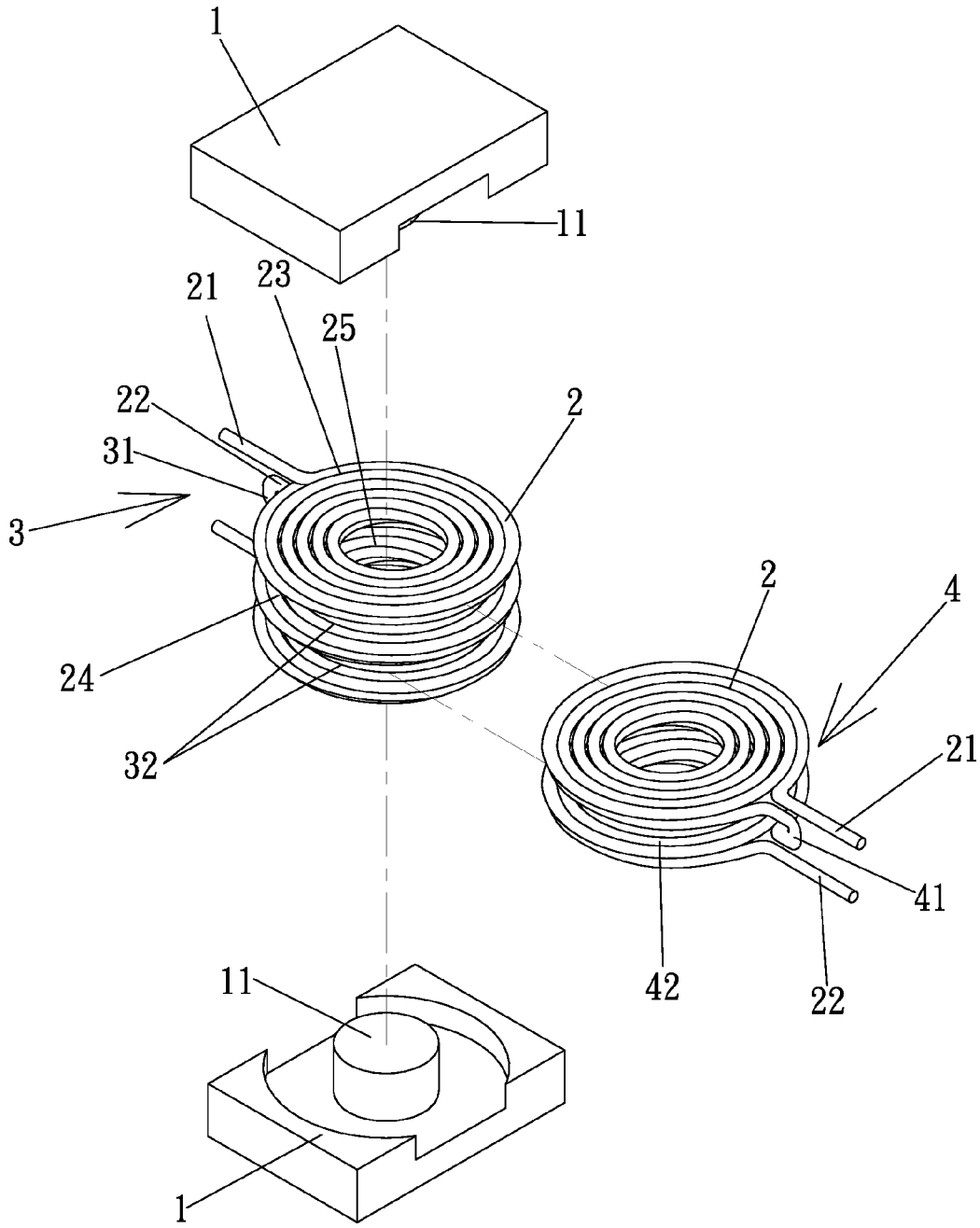
FIG. 3 shows an exploded, perspective view of a transformer of a first embodiment according to the preferred teachings of the present invention.
Figure 4:
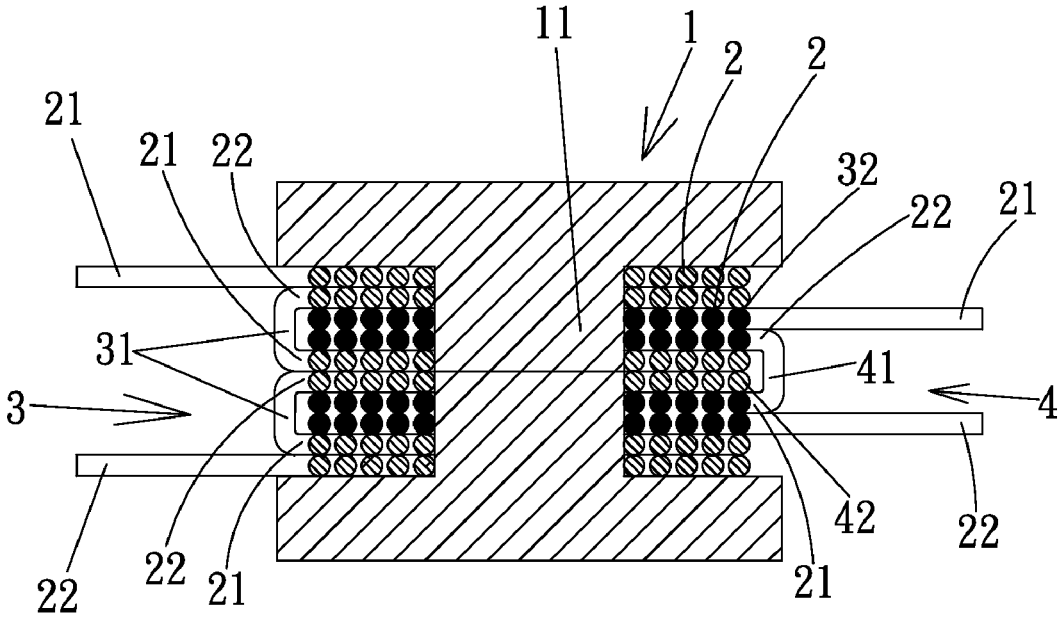
FIG. 4 shows a cross sectional view of the transformer of FIG. 3.

The coil modules 2 can include differing diameters according to design needs. The coil modules 2 can be stacked around the shaft 11 of the iron core 1 with the ends of the coil modules 2 interconnected to each other by series or parallel connection, so as to form transformers of isolated type, self-coupling type, or other types. FIGS. 3 and 4 show a transformer of a first embodiment according to the preferred teachings of the present invention. Specifically, the transformer shown in FIGS. 3 and 4 is of isolated type and includes primary and secondary windings 3 and 4. The primary winding 3 includes three coil modules 2, and the secondary winding 4 includes two coil modules 2, forming a voltage-decreasing transformer. One of the ends of each coil module 2 of the primary winding 3 is interconnected by an interconnecting section 31 to one of the ends of an adjacent coil module 2 of the primary winding 3. One of the ends of the coil modules 2 of the secondary winding 4 is interconnected by an interconnecting section 41 to one of the ends of the other coil module 2 of the secondary winding 4. In the preferred form shown in FIGS. 3 and 4, the lower end 22 of an upper one of two adjacent coil modules 2 is interconnected to the upper end 21 of a lower one of the two adjacent coil modules 2. It can be appreciated that the interconnecting sections 31 and 41 can be formed by the wires forming the coil modules 2 by winding. Alternatively, each of the interconnecting sections 31 and 41 can be formed by a conductive member. Two adjacent coil modules 2 of the primary winding 3 are spaced by a spacing 32 along an axis of the shaft 11. Likewise, the coil modules 2 of the secondary winding 4 are spaced by a spacing 42 along the axis. The spacing 42 is intermediate the spacings 32 along the axis. The coil modules 2 of the secondary winding 4 are received in the spacings 32 of the primary winding 3. The middle coil module 2 of the primary winding 3 is received in the spacing 42 of the secondary winding 4. The primary and secondary windings 3 and 4 are assembled together and then mounted around the shaft 11 of the iron core 1. By such an arrangement, no bobbin is required in the transformer according to the preferred teachings of the present invention. Thus, the transformer according to the preferred teachings of the present invention has a low profile and a reduced height compared to conventional transformers.

Figure 5:
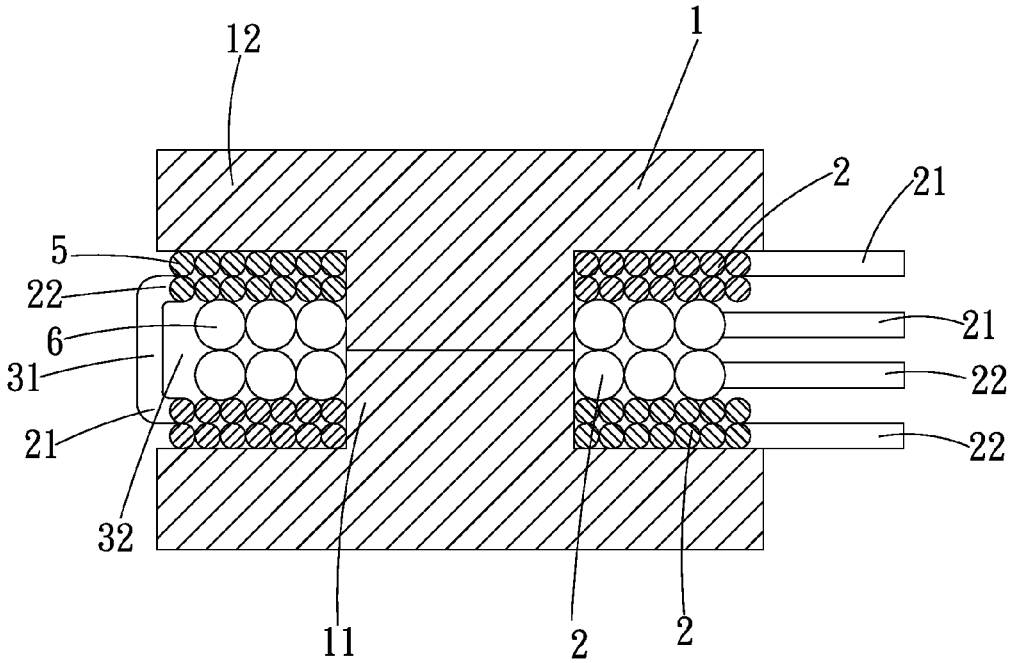
FIG. 5 shows a cross sectional view of a transformer of a second embodiment according to the preferred teachings of the present invention.

FIG. 5 shows a transformer of a second embodiment according to the preferred teachings of the present invention. The transformer of this embodiment is of isolated type and includes a primary winding 5 and a secondary winding 6. The primary winding 5 includes two coil modules 2 interconnected by an interconnecting portion 31 and spaced from each other along the axis of the shaft 11 of the iron core 1 by a spacing 32. The secondary winding 6 includes a coil module 2' received in the spacing 32 between the coil modules 2 of the primary winding 5. The primary and secondary windings 5 and 6 are intermediate the bases 12 of the iron core 1 along the axis. The coil module 2 of the secondary winding 6 has a wire diameter larger than the coil modules 2 of the primary winding 5. The wire diameters of the transformer according to the teachings of the present invention can be varied according to design needs.

Figure 6:
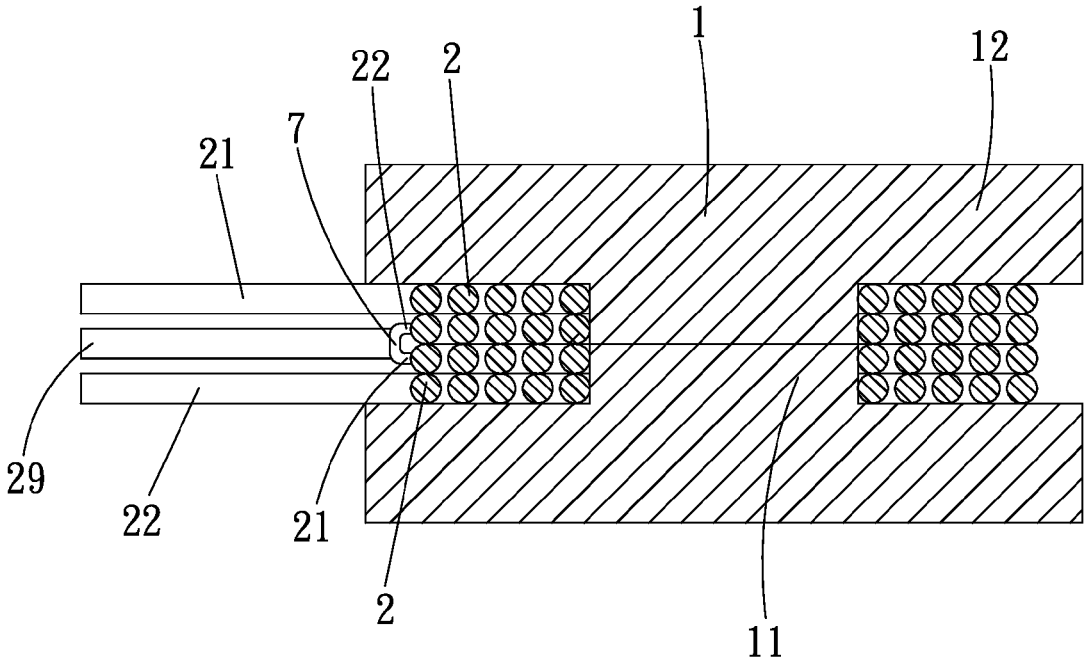
FIG. 6 shows a cross sectional view of a transformer of a third embodiment according to the preferred teachings of the present invention.

FIG. 6 shows a transformer of a third embodiment according to the preferred teachings of the present invention. The transformer of this embodiment is of self-coupling type and includes two coil modules 2 interconnected by a conductive member 7. Specifically, the lower end 22 of the upper coil module 2 is connected by the conductive member 7 to the upper end 21 of the lower coil module 2. A connection line 29 is coupled to the conductive member 7. The coil modules 2 are intermediate the bases 12 of the iron core 1 along the axis. The upper end 21 of the upper coil module 2 and the lower end 22 of the lower coil module 2 together define a primary side connection. The connection line 29 and the lower end 22 of the lower module 2 together define a secondary side connection.

Figure 7:
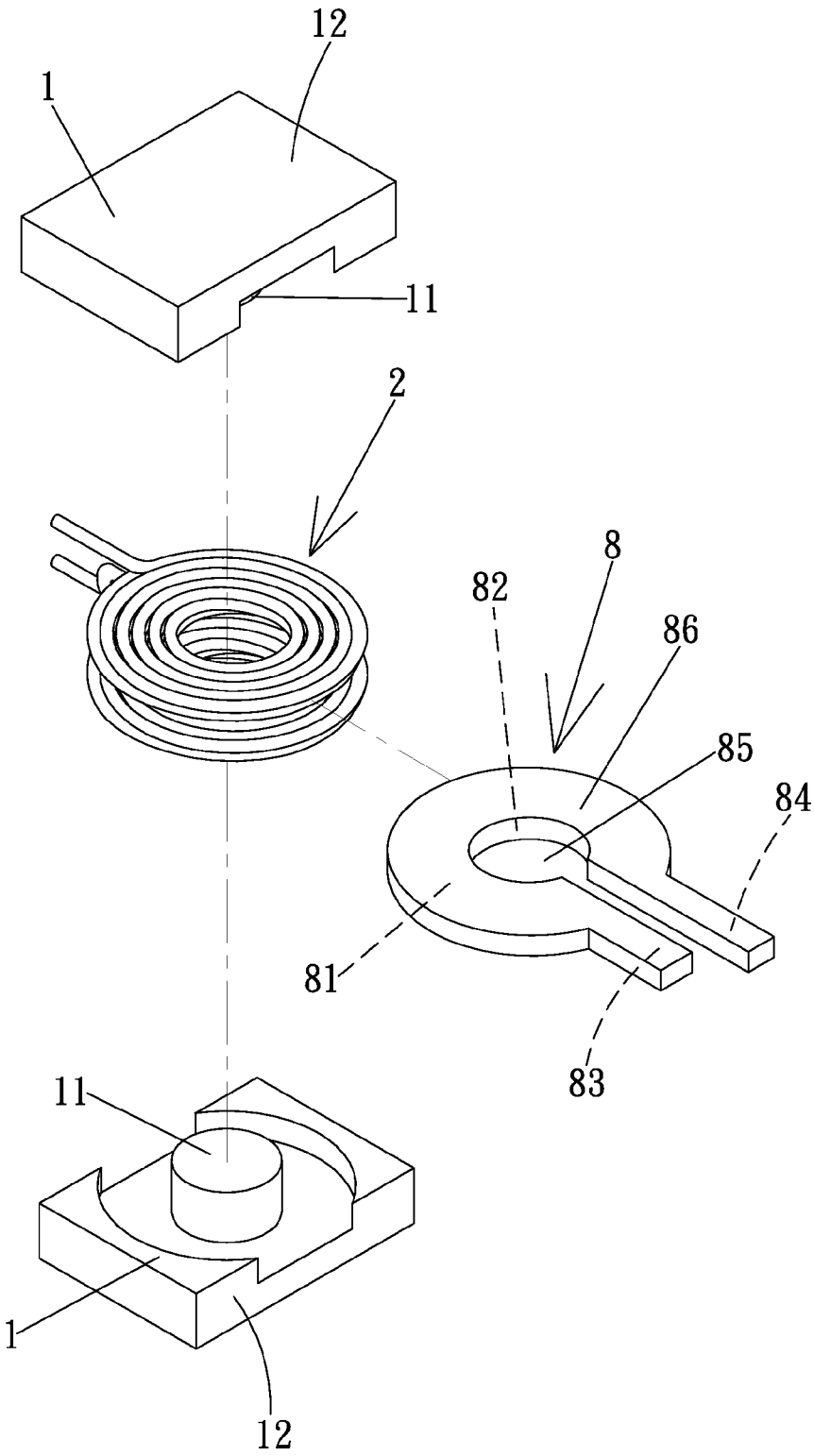
FIG. 7 shows an exploded, perspective, view of a transformer of a fourth embodiment according to the preferred teachings of the present invention.
Figure 8:
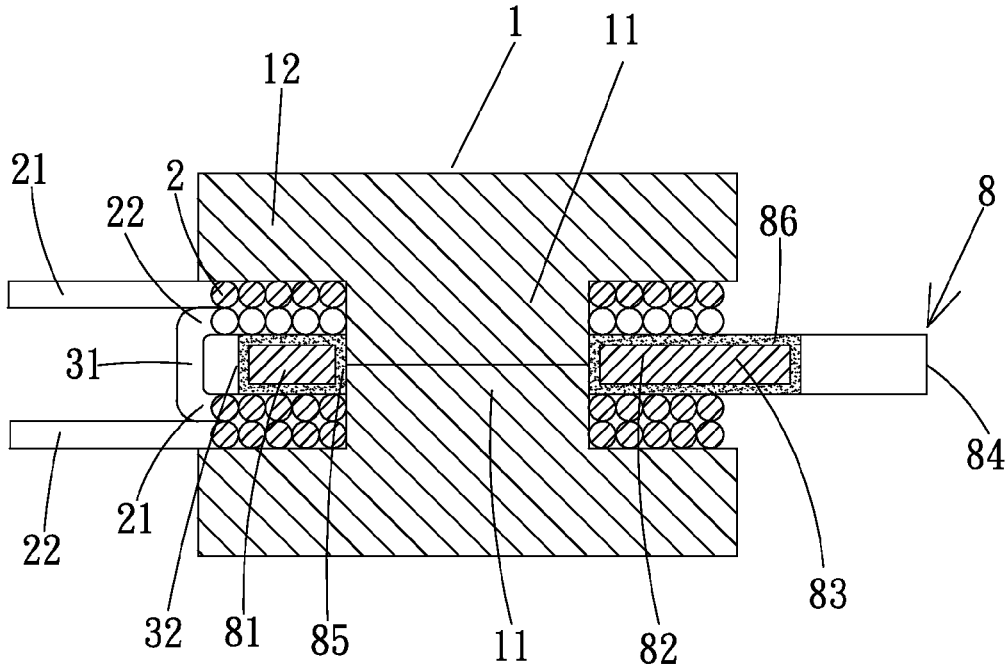
FIG. 8 shows a cross sectional view of the transformer of FIG. 7.
Figure 9:
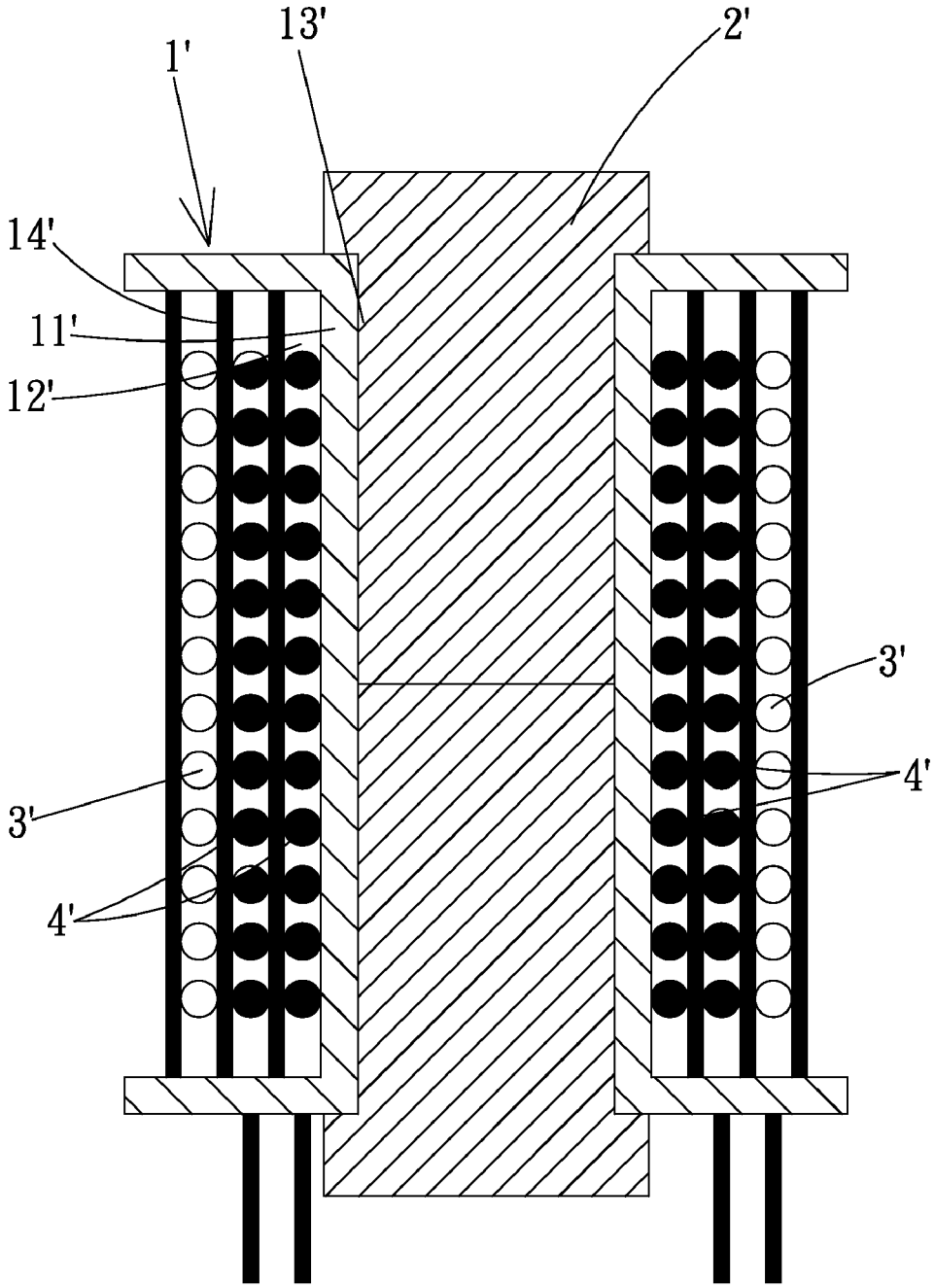
F I G . 9 Prior Art
FIG. 9 shows a cross sectional view of a conventional transformer.
Figure 10:
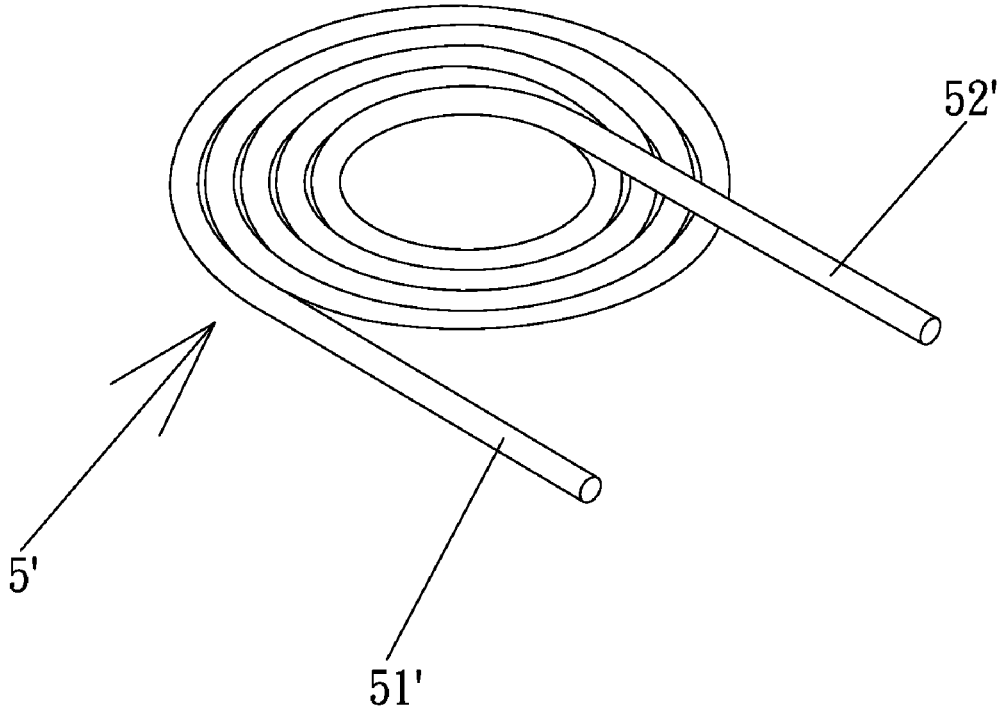
F I G .10 Prior Art
FIG. 10 shows a perspective view of a conventional coil for transformers.
Figure 11:
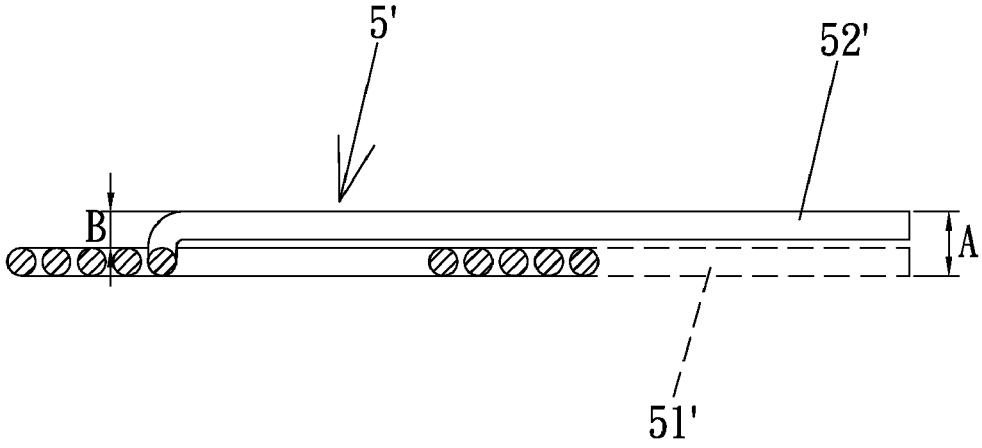
F I G .11 Prior Art
FIG. 11 shows a cross sectional view of the coil of FIG. 10.

FIGS. 7 and 8 show a transformer of a fourth embodiment according to the preferred teachings of the present invention. Specifically, the transformer of this embodiment includes two coil modules 2 on the primary side and another coil module 8 on the secondary side. The coil modules 2 are interconnected by an interconnecting section 31 and spaced from each other along the axis by a spacing 32. The coil module 8 in the preferred form shown is a conductive plate 81 made of copper, aluminum, or other conductive alloy. The conductive plate 81 can be formed by punching or any other suitable provisions. The conductive plate 81 includes an arcuate section 82 defining a coupling hole 85. Two legs 83 and 84 extend from two spaced ends of the arcuate section 82 and are spaced from each other. An insulating layer 86 is coated on the conductive plate 81. The conductive plate 81 is received in the spacing 32 of the coil modules 2. The coil modules 2 and the conductive plate 81 are intermediate the bases 12 of the iron core 1 along the axis of the shaft 11. The coil module 8 is suitable for large current load while providing a transformer with a low profile and low height.

The transformers according to the teachings of the present invention have low profiles due to provision of the two-layer coil modules 2 without using bobbins. Thus, the transformers according to the teachings of the present invention can be utilized in light, compact electric appliances.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A transformer comprising: an iron core including a shaft; and a plurality of coil modules mounted around the shaft, wherein each of the plurality of coil modules being electrically conductive and having an insulating surface, wherein each of the plurality of coil modules including spiral, upper and lower coil sections and upper and lower ends electrically connected to each other via the spiral, upper and lower coil sections, wherein the spiral upper coil section including an upper, outer loop and a plurality of upper, inner loops received in and coplanar wherein the upper, outer loop and having diameters smaller than the upper, outer loop, wherein the spiral lower coil section including a lower, outer loop and a plurality of lower, inner loops received in and coplanar wherein the lower, outer loop and having diameters smaller than the lower, outer loop, wherein the plurality of upper, inner loops and the plurality of lower, inner loops including a common innermost loop, wherein the shaft of the iron core extending through the common innermost loop, wherein the upper end interconnected to the upper, outer loop, wherein the lower end interconnected to the lower, outer loop, wherein the spiral upper section superimposed on the spiral lower section to form a two-layer structure, wherein the lower end of an upper one of two adjacent coil modules interconnected to the upper end of a lower one of the two adjacent coil modules.

2. The transformer as claimed in claim 1, with each of the plurality of coil modules formed by winding an enamel-covered wire.

3. The transformer as claimed in claim 1, with the upper, outer loop of each of the plurality of coil modules aligned with the lower, outer loop of the coil module, and with the plurality of upper, inner loops of each of the plurality of coil modules aligned with the plurality of lower, inner loops of the coil module.

4. The transformer as claimed in claim 1, with one of the plurality of coil modules having a wire diameter different from a remainder of the plurality of coil modules.

5. A transformer comprising: an iron core including a shaft having an axis; a primary winding mounted around the shaft and including a plurality of first coil modules, wherein each of the plurality of first coil modules being electrically conductive and having a first insulating surface, wherein each of the plurality of first coil modules including a spiral, first, upper coil section, a spiral, first, lower coil section, and upper and lower ends electrically connected to each other via the spiral, first, upper and lower coil sections, wherein the spiral, first upper coil section including a first upper, outer loop and a plurality of first, upper, inner loops received in and coplanar wherein the first, upper, outer loop and having diameters smaller than the first, upper, outer loop, wherein the spiral, first, lower coil section including a first, lower, outer loop and a plurality of first, lower, inner loops received in and coplanar wherein the first, lower, outer loop and having diameters smaller than the first, lower, outer loop, wherein the plurality of first, upper, inner loops and the plurality of first, lower, inner loops including a first common innermost loop, wherein the shaft of the iron core extending through the first common innermost loop, wherein the upper end of each of the plurality of first coil modules interconnected to the first, upper, outer loop of the first coil module, wherein the lower end of each of the plurality of first coil modules interconnected to the first, lower, outer loop of the first coil module, wherein the spiral, first, upper section superimposed on the spiral, first, lower section to form a first two-layer structure, wherein the lower end of an upper one of two adjacent first coil modules interconnected to the upper end of a lower one of the two adjacent first coil modules; and a secondary winding mounted around the shaft and including a plurality of second coil modules, wherein each of the plurality of second coil modules being electrically conductive and having a second insulating surface, wherein each of the plurality of second coil modules including a spiral, second, upper coil section, a spiral, second, lower coil section, and upper and lower ends electrically connected to each other via the spiral, second, upper and lower coil sections, wherein the spiral, second, upper coil section including a second upper, outer loop and a plurality of second, upper, inner loops received in and coplanar wherein the second, upper, outer loop and having diameters smaller than the second, upper, outer loop, wherein the spiral, second, lower coil section including a second, lower, outer loop and a plurality of second, lower, inner loops received in and coplanar wherein the second, lower, outer loop and having diameters smaller than the second, lower, outer loop, wherein the plurality of second, upper, inner loops and the plurality of second, lower, inner loops including a second common innermost loop, wherein the shaft of the iron core extending through the second common innermost loop, wherein the upper end of each of the plurality of second coil modules interconnected to the second, upper, outer loop of the second coil module, wherein the lower end of each of the plurality of second coil modules interconnected to the second, lower, outer loop of the second coil module, wherein the spiral, second, upper section superimposed on the spiral, second, lower section to form a second two-layer structure, wherein the lower end of an upper one of two adjacent second coil modules interconnected to the upper end of a lower one of the two adjacent second coil modules.

6. The transformer as claimed in claim 5, with two adjacent first coil modules being spaced by a first spacing along the axis, with two adjacent second coil modules being spaced by a second spacing along the axis, with each of the plurality of second coil modules received in one of the first spacings, and with one of the plurality of first coil modules received in the second spacing.

7. The transformer as claimed in claim 5, each of the plurality of coil modules formed by winding an enamel-covered wire, with the lower end of an upper one of two adjacent first coil modules interconnected by a section of the wire to the upper end of a lower one of the two adjacent first coil modules.

8. The transformer as claimed in claim 5, each of the plurality of coil modules formed by winding an enamel-covered wire, with the lower end of an upper one of two adjacent first coil modules interconnected by a conductive member of the wire to the upper end of a lower one of the two adjacent first coil modules.

9. A transformer comprising: an iron core including a shaft having an axis; upper and lower coil modules mounted around the shaft, wherein each of the upper and lower coil modules being electrically conductive and having an insulating surface, wherein each of the first and second coil modules including spiral, upper and lower coil sections and upper and lower ends electrically connected to each other via the spiral, upper and lower coil sections, wherein the spiral upper coil section including an upper, outer loop and a plurality of upper, inner loops received in and coplanar wherein the upper, outer loop and having diameters smaller than the upper, outer loop, wherein the spiral lower coil section including a lower, outer loop and a plurality of lower, inner loops received in and coplanar wherein the lower, outer loop and having diameters smaller that the lower, outer loop, wherein the plurality of upper, inner loops and the plurality of lower, inner loops including a common innermost loop, wherein the shaft of the iron core extending through the common innermost loop, wherein the upper end interconnected to the upper, outer loop, with the lower end interconnected to the lower, outer loop, wherein the spiral upper section superimposed on the spiral lower section to form a two-layer structure, wherein the lower end of the upper coil module interconnected to the upper end of the lower coil module, wherein the upper and lower coil modules spaced by a spacing along the axis; and a conductive plate including an arcuate section defining a coupling hole through which the shaft extends, wherein the conductive plate received in the spacing, wherein the arcuate section including two spaced ends, wherein first and second legs respectively extending from the two spaced ends of the arcuate section and spaced from each other, wherein the conductive plate covered by an insulating layer.

10. The transformer as claimed in claim 9, with the transformer including a primary side and a secondary side, with the plurality of coil modules on the primary side, and with the conductive plate on the secondary side.

* * * * *